US006619620B1

(12) United States Patent
Carter

(10) Patent No.: US 6,619,620 B1
(45) Date of Patent: Sep. 16, 2003

(54) VEHICLE HOIST

(76) Inventor: William Shane Carter, 139 Somerset Drive, Mt Martha, Victoria 3134 (AU)

( * ) Notice: Subject to any disclaimer, the term of this patent is extended or adjusted under 35 U.S.C. 154(b) by 0 days.

(21) Appl. No.: 09/581,461

(22) PCT Filed: Dec. 11, 1998

(86) PCT No.: PCT/AU98/01030

§ 371 (c)(1),
(2), (4) Date: Jun. 12, 2000

(87) PCT Pub. No.: WO99/31004

PCT Pub. Date: Jun. 24, 1999

(30) Foreign Application Priority Data

Dec. 12, 1997 (AU) ..... PP 0859

(51) Int. Cl.[7] ..... B66F 11/04
(52) U.S. Cl. ..... 254/10 C
(58) Field of Search ..... 254/2 R, 2 B, 254/2 C, 9 R, 9 B, 9 C, 10 R, 10 B, 10 C

(56) References Cited

U.S. PATENT DOCUMENTS 3,840,210 A * 10/1974 Hollingsworth ..... 254/9 R
4,173,810 A * 11/1979 James ..... 16/47
4,564,172 A * 1/1986 Arzouman ..... 254/8 B
4,899,987 A 2/1990 Craig
4,925,158 A * 5/1990 Yang ..... 254/8 B
5,007,121 A * 4/1991 McEathron ..... 254/10 C
5,156,238 A 10/1992 Matthews
5,322,143 A 6/1994 Curran
5,518,224 A * 5/1996 Anderson ..... 254/131

FOREIGN PATENT DOCUMENTS

WO WO 96/36555 11/1996

* cited by examiner

*Primary Examiner*—Robert C. Watson
(74) *Attorney, Agent, or Firm*—Buchalter, Nemer, Fields and Younger

(57) ABSTRACT

A hoist for a vehicle including a lower chassis (2) adapted for secure placement on and optional general movement about a floor, an upper platform (1) fitted to said chassis and movable between a first lowered position to a second raised position wherein said hoist is capable of placement underneath a vehicle when in said first position and said platform and chassis remain coplanar during movement between said first and second positions and both said platform and said chassis have a footprint sufficient to allow stable holding of a vehicle when mounted on said hoist characterized in that said hoist is fitted with a locking means for holding said upper platform in said raised position said locking means including an elongate locking arm (24) pivotally fitted to one end (52) of said chassis and telescopically passing through a collar (25) pivotally fitted to the other corresponding end (53) of said platform wherein said collar has a lock adapted to co-operate with said locking arm, to arrest said telescopic movement and lock said hoist.

16 Claims, 7 Drawing Sheets

1
2
4
5
6
9
10
11
12
13
15
16
17
19
20
21
24
25
44
51

VEHICLE HOIST

This invention relates to hoists and in particular to motor vehicle hoists which are portable and mobile allowing an operator to manually move and manipulate an elevated motor vehicle.

BACKGROUND TO INVENTION

The motor vehicle industry, particularly that part of the industry involved in maintenance, repair and renovation, has a constant demand for aids to assist in the manipulation and handling of vehicle bodies which cannot be handled confidently without mechanical assistance.

Such aids include lifting devices, mounting devices and holding devices of various descriptions. Lifting devices range from simple one point jacks which lift a single point on a vehicle to massive inground fixed hoists which raise the entire vehicle to allow clear standing access underneath.

Mounting devices include simple axle stands and ramps to complex jigs capable of rotating a vehicle from a horizontal to a vertical orientation.

Whilst all the previously mentioned devices have clear application and use in the industry, one of the more frequent requirements in the industry is to easily manipulate and move a vehicle which may have no wheels, damaged suspension, no engine etc; or move a collection of vehicles in a confined space, or simply raise an entire vehicle half a meter or so where it stands to allow clear access underneath.

To date, none of the available devices cater for the above range of handling requirements. Workshop situations often find vehicles precariously placed on four individual axle stands or suspended on trolley jacks. Inground hoists also present limitations as vehicles are fixed at one place in a workshop until they are mobile of their own componentry and the hoist is unavailable for other uses. Inground hoists are also highly expensive installations.

Other solutions are available including placing vehicles on elevated trolleys of a fixed height; however, such devices require the elevation of the vehicle to the trolley height and do not provide a complete solution to the above-described problem.

One object of the invention is to provide an improved vehicle hoist which is compact and capable of raising and readily moving a vehicle without further mechanical assistance with one operator.

STATEMENT OF INVENTION

In one aspect, the invention provides A hoist for a vehicle including a lower chassis adapted for secure placement on and optional general movement about a floor, an upper platform fitted to said chassis and movable between a first lowered position to a second raised position wherein said hoist is capable of placement underneath a vehicle when in said first position and said platform and chassis remain coplanar during movement between said first and second positions and both said platform and said chassis have a footprint sufficient to allow stable holding of a vehicle when mounted on said hoist characterised in that said hoist is fitted with a locking means for holding said upper platform in said raised position said locking means including an elongate locking arm pivotally fitted to one end of said chassis and telescopically passing through a collar pivotally fitted to the other corresponding end of said platform wherein said collar has a lock adapted to co-operate with said locking arm to arrest said telescopic movement and lock said hoist.

The lock preferably incorporates a pawl fitted to the pivoted collar which may be spring loaded and bias to intercept the travel path of the locking arm as it passes through the collar. The locking arm may be provided with a plurality of protuberances or indentations along its length which are adapted to co-operate with the pawl to arrest any backward movement of the locking arm and hoist.

The pawl preferably acts through a pivot positioned to allow the pawl to engage the locking arm by an over center motion thereby ensuring that once the pawl has engaged a step or indention in the locking arm, it is only possible to release the pawl if the locking arm has moved forward so as to allow the pawl sufficient space to again move over center and withdraw thereby releasing the lock. The hoist may also include wheel means to provide mobility to the hoist if required. The wheel means may be castor systems including a swivel housing fitted to the lower chassis which can sit on the floor when the wheels are retracted or optionally elevate the hoist by the raising of an arm pivoted intermediate on said housing where the arm has a wheel fitted at the other end.

The footprint of said hoist is preferably at least 20% of the mounted vehicles wheel footprint.

The hoist may have a substantially rectangular footprint in the lower chassis and upper platform with raising arms pivotally fitted in the region of the respective corners of said lower chassis and said upper platform so as to allow said upper platform to be raised and lowered relative to said chassis causing said platform to offset forward or rearward during said raising and lowering.

The hoist may be moved between said first and second positions by a ram fitted between a rearward position on said lower chassis and a forward position on said upper platform such that activation of said ram causes said upper platform to simultaneously move forward and up relative to said chassis.

The upper platform may be adapted to lay flat against said chassis when in said first position.

The raising arms may be of equal length and corresponding fitting to each corner region of the hoist The arms may be provided with steps to limit the raised position of the hoist to pre-overcentering of said raising arms.

The invention will now be described in greater detail with reference to one particular embodiment shown in the accompanying representations.

Figures 1, 3, 4:
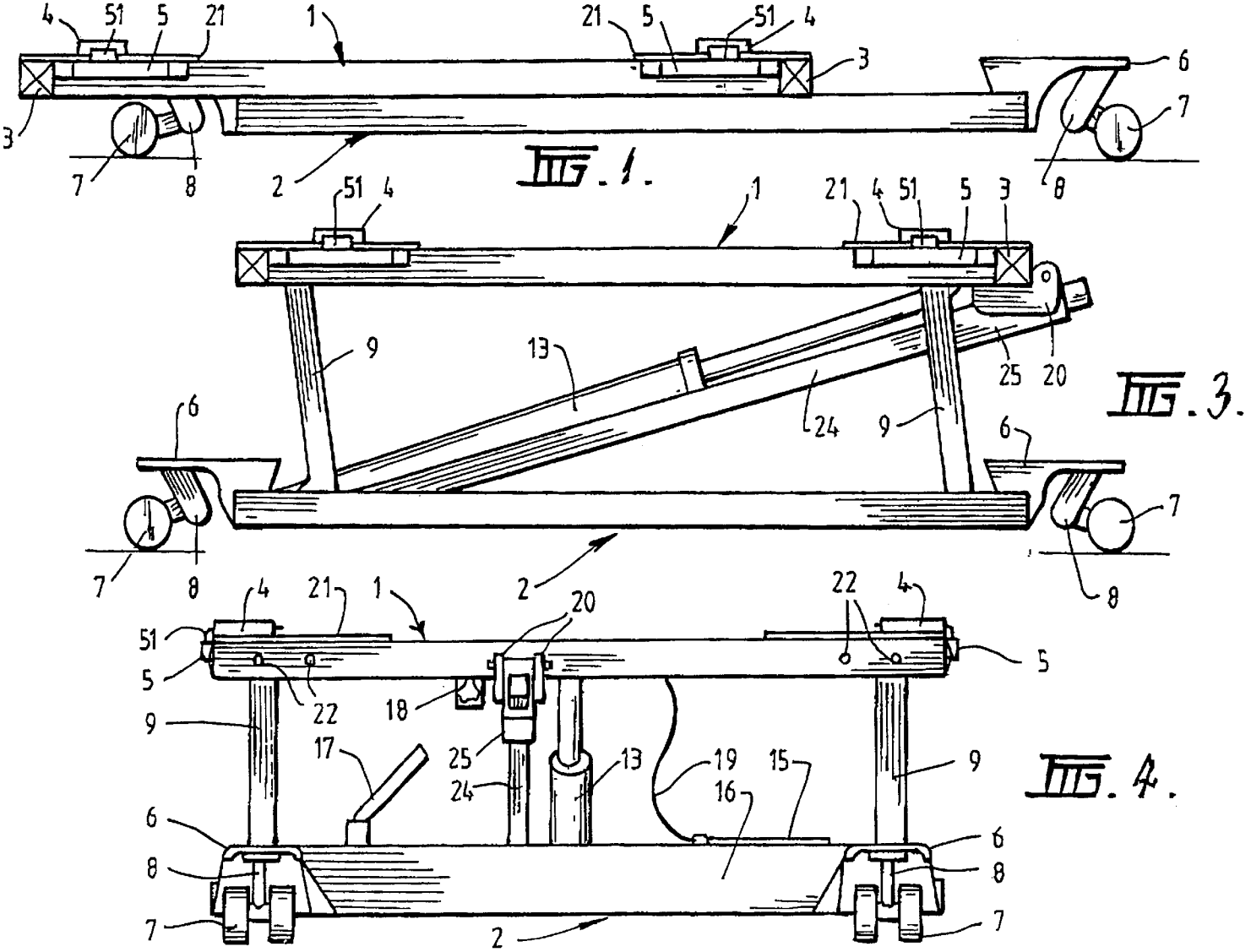
FIG. 1 shows a side view of the collapsed hoist in a lowered position.
FIG. 3 shows a side view of the raised hoist.
FIG. 4 shows an end view of the raised hoist.

LEGEND FOR FIGURES (1) Upper platform.
(2) Lower chassis.
(3) Corner impact cushions.
(4) Rubber blocks which seat between vehicle underbody and (1).
(5) Slide channels for (4) which are welded to (1).
(6) Wheel mounts which are welded to (2).
(7) Twin wheel castor system.
(8) Wheel housing that incorporate 2 roller bearing sets in a swivel head.
(9) Raising arms that hinge and join (1) to (2) platforms together at each end of (9) is greasing point.
(10) At each end of the lifting arms (9) is a machined collett to lock arms between (1) and (2).
(11) Checker plate which is welded to (2) and acts as a cover for the hydraulic linkages.
(12) Checker plate which is welded to (1) and acts as a cover for the hydraulic linkages.
(13) Main hydraulic ram which is mounted diagonally between (1) and (2).
(14) Hydraulic hose burst valve, which is activated when (19) is severed or cut.
(15) Position for power source either A) air over hydraulic Power Pack or B) 240 Volt over hydraulic power pack, or C) 12 Volt (Car battery) over hydraulic power pack. This flexibility of power source offers wide application.
(16) Checker plate covers to protect (not welded) power pack (15) and also to protect hydraulic line (36) that runs from wheels (37) to main hand pump (17).
(17) Small hand pump unit secured under (16) which activates hydraulic rams (37) and the four retractable wheel means.
(18) The pull knob and lever to release The Safety Locking Unit (25) and allow the locking bar (24) to lower.
(19) The hydraulic hose which runs from (13) to (15).
(20) The twin brackets which support and pivots the safety-locking unit (25) from (48).
(21) Corner checker plate, which acts as strengthening braces on four corners and anti-skid surfaces for (4).
(22) Nut-serts are located in (1) to bolt auxiliary brackets to bench to support vehicle 8 in total.
(24) Locking arm hinged and secured diagonally between (1) and (2), with the upper end moving through (25).
(25) Collar which is hinged (48) and pivoted at it's base to (1).
(30) Countersunk bolts secure (6) to (31) to (8) on each of the four wheel means.
(31) Spacer plates, designed to give support to (8) and give clearance to (36).
(32) Dog-bone shaped arms that hinge between (35) and (34). Pressure from (38) causes (32) to pivot downward giving elevation to hoist. Retraction is by release of pressure from (17) causing (38) to release allowing (32) to retract.
(33) Retaining nut that holds (38) in place and prevents (38) from over-stroking.
(34) Wheel axle that secures (7) to (34).
(35) Rear axle that pivots (32) to (8).
(36) Hydraulic pipes that run inside (2) back to (17).
(37) Wheel ram body, which is secured in position by clearance, fit through (8) and pinned to (31).
(38) Hydraulic piston that is fixed inside (37) and retained by (33) and radius end sits on surface of (32).
(39) Rubber hydraulic seal that is secured to (38).
(40) Lever arm for releasing (46) upward when (1) is descending, lever is activated by pulling (18).
(41) Top dust cover that is secured by 6× (42's) to main body (25).
(42) Allen Head set screws.
(43) Main central shaft by pulling (18), (40) then turns (43) in anti-clockwise direction. This lifts (49), which in turn lifts (47). This is only possible when the hoist is under load and supported by the hydraulic ram (13). The hoist can never be lowered without the hydraulic ram (13) under load and in place. Until pressure is taken up by (13), (46) will bear up hard against (24) and prevent accidental release.

-continued

LEGEND FOR FIGURES

(44) Indentation.
(45) Spring to return (46).
(46) Main locking pawl.
(47) Shaft to pivot and secure (46).
(48) Main hinge lug welded to safety locking unit (25).
(49) Lifting arm pinned to (43), when activated will lift (47). If (18) is ever physically let go for any reason (46) will automatically return to it's position locking up the hoist at that point of descent.
(50) Locating pin for (45).
(51) Inner reinforcement for (4).
(52) Rearward position.
(53) Forward position.
(54) Bearing face.
(55) Indentation face.

DETAILED DESCRIPTION OF THE INVENTION

Referring firstly to FIGS. 1 to 5, the hoist is generally provided with a raisable parrallagram mechanism comprising a substantially rectangular lower chassis 2 which is provided at each corner with a retractable wheel means 7/8 which provides the chassis with general mobility in all directions across the workshop floor when the wheels are in a raised position and if required, allows the lower chassis to sit firmly on a workshop floor when the wheels have been retracted so as to prevent any unwanted movement of the chassis or hoist. The hoist is provided with an upper platform 1 of generally rectangular configuration and of similar dimensions and footprint to that of the lower chassis. The upper platform is fitted to the lower chassis and movable between a first lowered position where the upper platform and lower chassis sit substantially on top of the other to a second raised position. The upper platform 1 and lower chassis 2 are connected by way of four raising arms 9 pivotally attached at each respective corner of said upper platform and lower chassis. The raising arms 9 are all of substantially identical length and accordingly allow the upper platform to be pivotally raised and lowered in a manner ensuring that the upper platform remains co-planar with the chassis and accordingly, co-planar with the floor. The relative movement of the upper platform and chassis is effected by a main hydraulic ram 13 which is fitted diagonally between a rearward position 52 on the lower chassis 2 and a forward position 53 on the upper platform 1 such that the activation of the ram causes the upper platform to move both forward and upward relative to the lower chassis thereby effecting the raising of the upper platform and the lifting of any vehicle positioned on said upper platform.

In order to ensure complete safety in the use of the hoist, the upper platform is fitted with a locking means comprising an elongate locking arm 24 which is pivotally attached to a rearward position on said lower chassis and adapted to pass through a locking collar 25 which is pivotally fitted to a forward position on the upper platform 1. The movement of the hoist between the raised and lowered positions causes the locking arm to slide telescopically back and forth through the collar which is provided with a suitable lock to arrest this telescopic movement and accordingly arrest the vertical movement of the hoist at any desired position.

Figure 10:
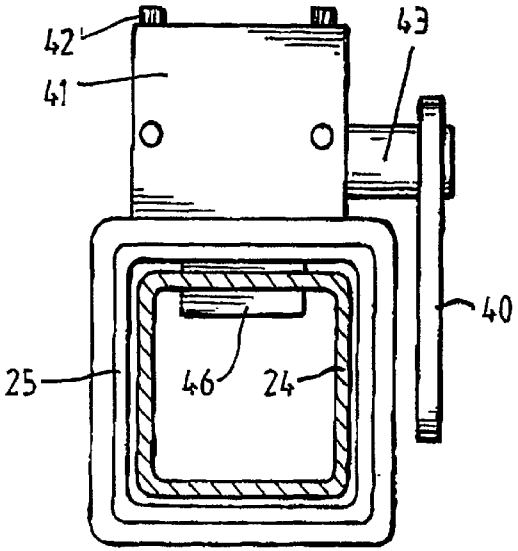
FIG. 10 shows an end view of the locking means.
Figure 9:
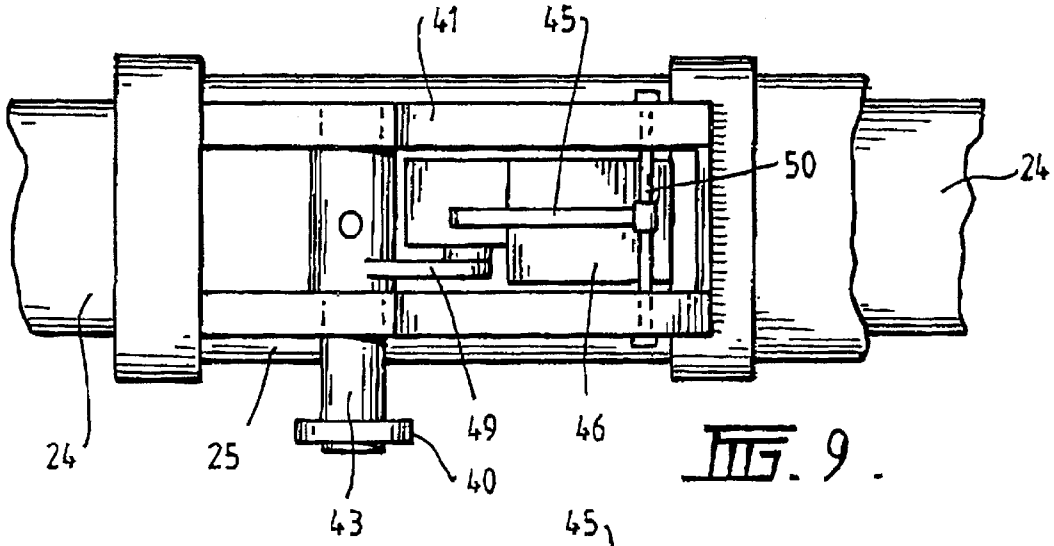
FIG. 9 shows a top view of the locking means.
Figure 11:
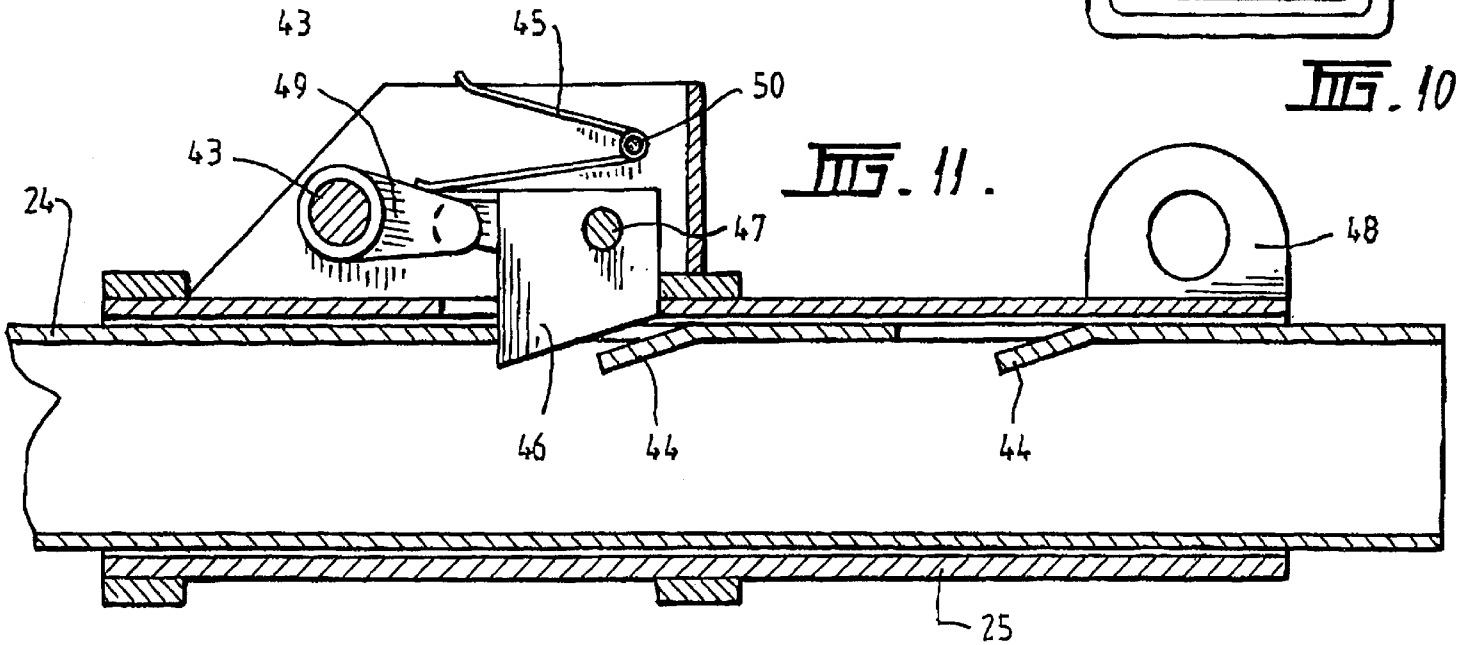
FIG. 11 shows a sectional side view of the locking means.
Figure 13:
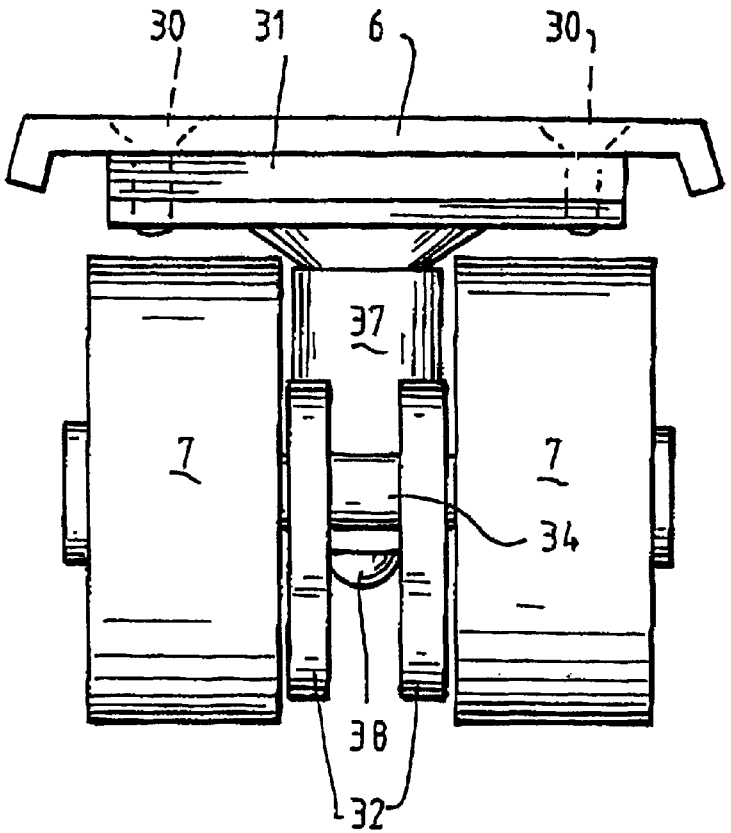
FIG. 13 shows an end view of the retracted wheel means.
Figure 12:
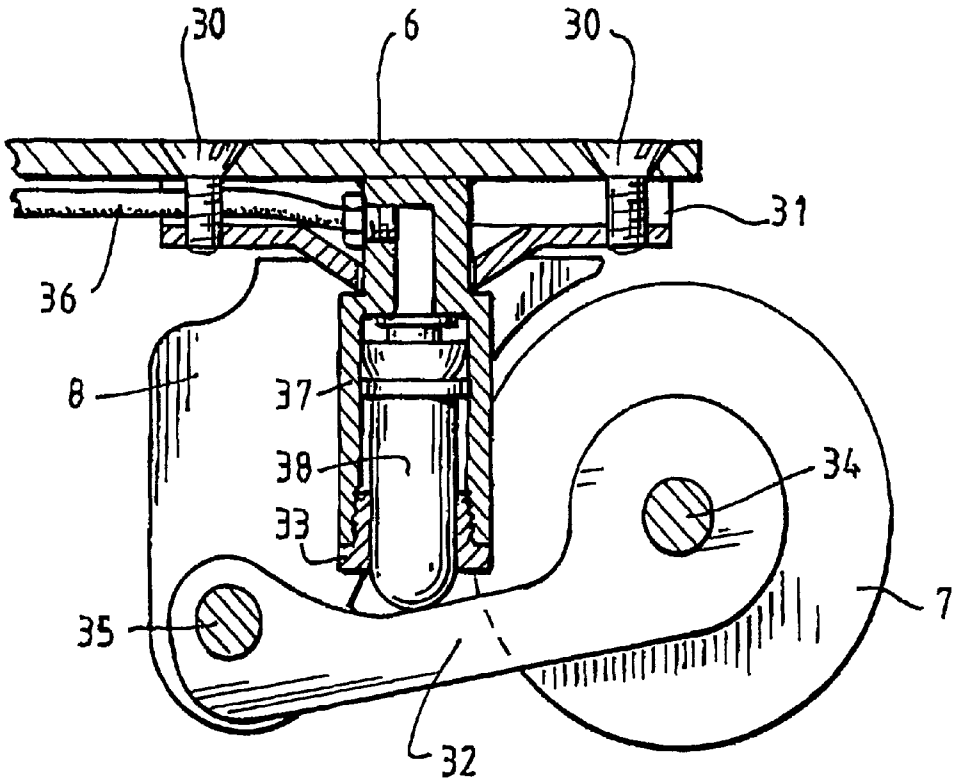
FIG. 12 shows a side view of the retractable wheel means in a retracted position.
Figure 15:
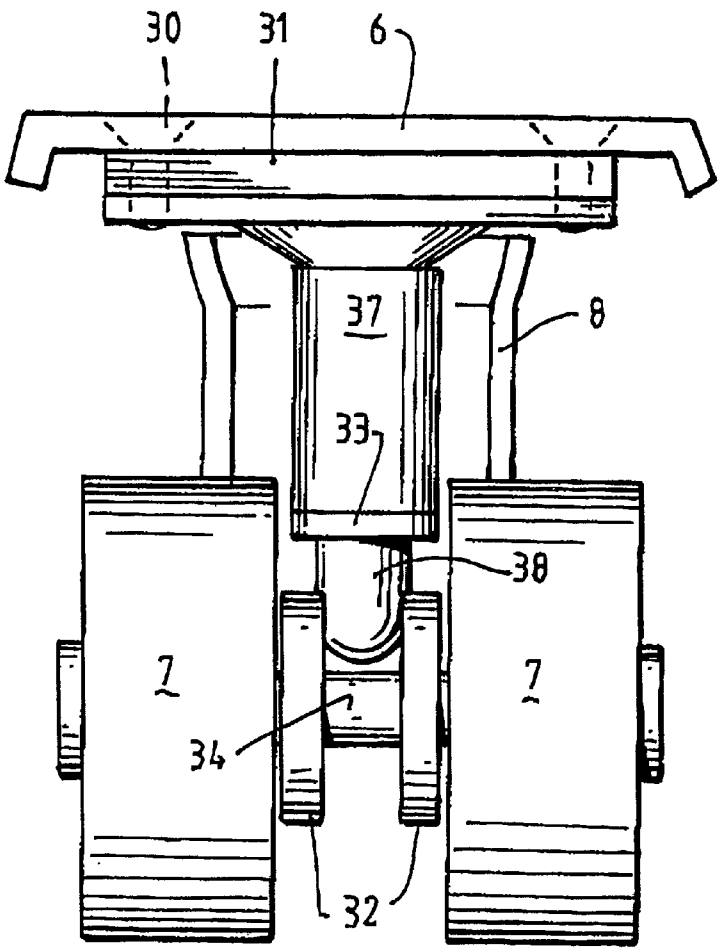
FIG. 15 shows an end view of the raised wheel means.
Figure 14:
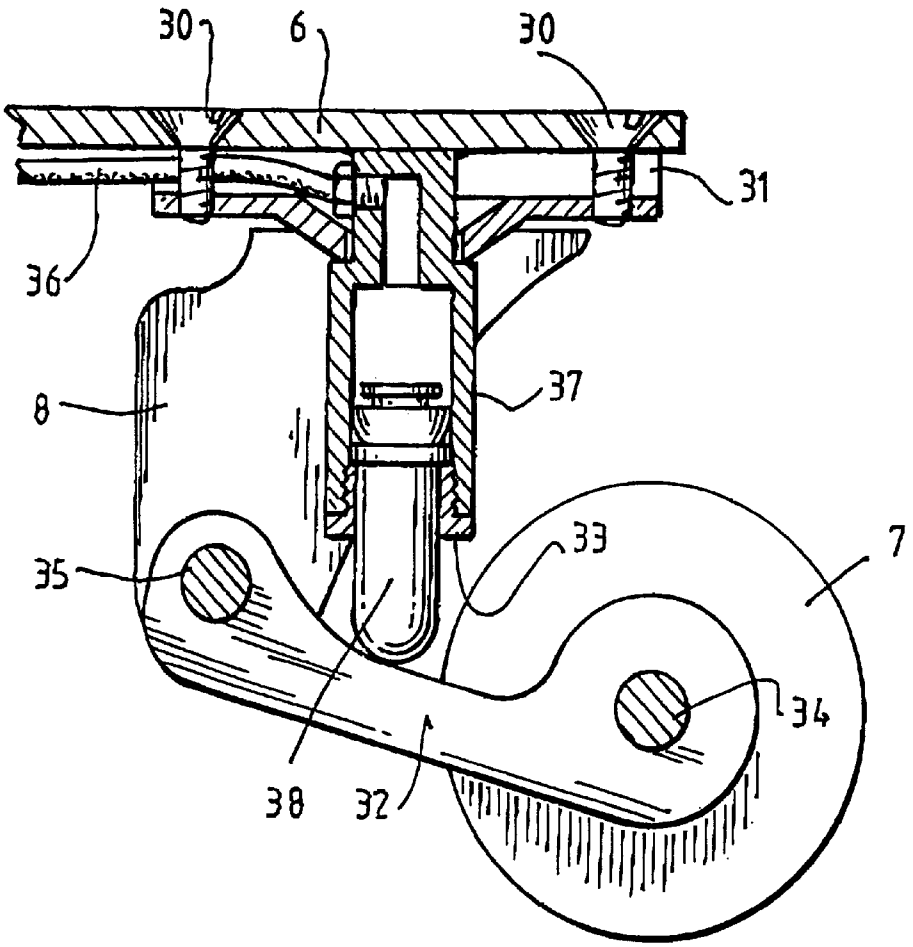
FIG. 14 shows a side view of the wheel means in a raised position.

Referring now go FIGS. 9 to 11, the locking means can be seen to comprise an elongate locking arm 24 adapted for telescopic and coaxial movement through a collar 25. The elongate locking arm 24 has formed along its length one or a plurality of protuberances or indentations 44 which forms steps which are adapted to cooperate with a lock positioned on the collar. The lock takes the form of a ratchet mechanism comprises a pivoted pawl 46 which is formed in a housing associated with the collar. The pawl is adapted to be pivoted around pivot point 47 and manually activated by way of a lifting arm 49 pivoted at a central shaft 43 providing external access for release of the paw). The pawl is held in an engaged position by way of spring 45 which serves to urge the pawl into a position so as to intercept the indentations 44 of the locking arm 24. The spring also allows the pawl to act as a ratchet allowing the locking arm to move through the collar in one direction only until the pawl is released. The movement of the locking arm 24 telescopically and coaxially through the collar causes the locking pawl to act as a ratchet and successively engage the respective indentations 44. The particular action and configuration of the locking pawl is such that the bearing face of the pawl 54 which rests against the indentation face 55, is configured so as to lockably engage the indentation face when the pawl has moved over center so as to prevent the locking pawl withdrawing whilst the bearing face 54 is in contact with the indentation face 55. This arrangement has the effect of allowing the locking pawl to function as a ratchet while the locking arm is being pushed through the collar during the raising action of the hoist. However, whilst the hoist is in any position with the locking pawl engaging an indentation 44, it is impossible to release the locking pawl unless the locking arm has been pushed forward to some degree to allow sufficient room for the locking pawl to again move over center and withdraw. This provides an important safety feature such that the locking means of the hoist can provide the user with a confident and perfectly safe way of securing the hoist at any one of a number of raised positions such that the main hydraulic ram and, in fact, all the hydraulic systems can be removed from the hoist once it is in a suitable raised position with confidence knowing that without the ability to further raise the locking arm 24 (which can only be done with the hydraulics in place), it would not be possible to release the locking pawl from the locking arm and lower the hoist.

Once the hoist has been locked in the desired position, the ram and general hydraulic components of the hoist can be completely removed in order to ensure that the components of the hoist are not damaged by any of the actions or environment of a vehicle repair shop including welding, spraying and other actions that could otherwise damage the delicate hydraulics of such a device.

In order to ensure the maximum scope of operation of the hoist, the raising arms 9 are provided with a crank at a first end. The position of the crank allows the upper platform to fold down and sit snugly on top of the lower chassis 2 thereby providing minimum lower height of the collapsed hoist so as to allow ready hoist access to the underbody of a vehicle. The raising action of the hoist places the ram 13 under constant load and in order to ensure the ram remains under constant and smooth load during the whole of the raising action, the raising arms 9 are provided with stops or collets 10 which prevent the raising arms for moving beyond their overcenter position, thereby ensuring that the hoist does not move beyond its maximum height and keeps the ram under constant load until the required height is achieved when the load can be relieved by activation of a locking mechanism as previously described.

Referring now to FIGS. 12 to 15, the retractable wheel means of the hoist are shown in some detail and can be seen to comprise a housing 8 pivotally or swiverly connected to the lower chassis 2 around the wheel ram body 37 so as to provide the wheel with the general rotational or swivel action to ensure complete horizontal mobility of the hoist. The wheel means are retractable from a first raised position with the hoist lifted off the ground to a second lower position with the hoist lowered down onto the ground by way of contact with the wheel housing 8. The wheel 7 comprises twin wheel casters which are pivotally attached at 34 to one end of an arm 32 which is in turn-pivotally connected at 35 at the other end to an intermediate position on the housing 8. The arm can be activated by way of a ram 38 which bears down upon an intermediate position along the arm and causes the arm to move between a raised position and a lowered position so as to provide mobility for the hoist or provide the hoist with a firm seating on the ground or floor where the bottom of the wheel housing 8 sits firmly on the floor. The raised and lowered positions can be seen in clear contrast by comparing FIGS. 12, 14 and 13 and 15 as required.

Figure 2:
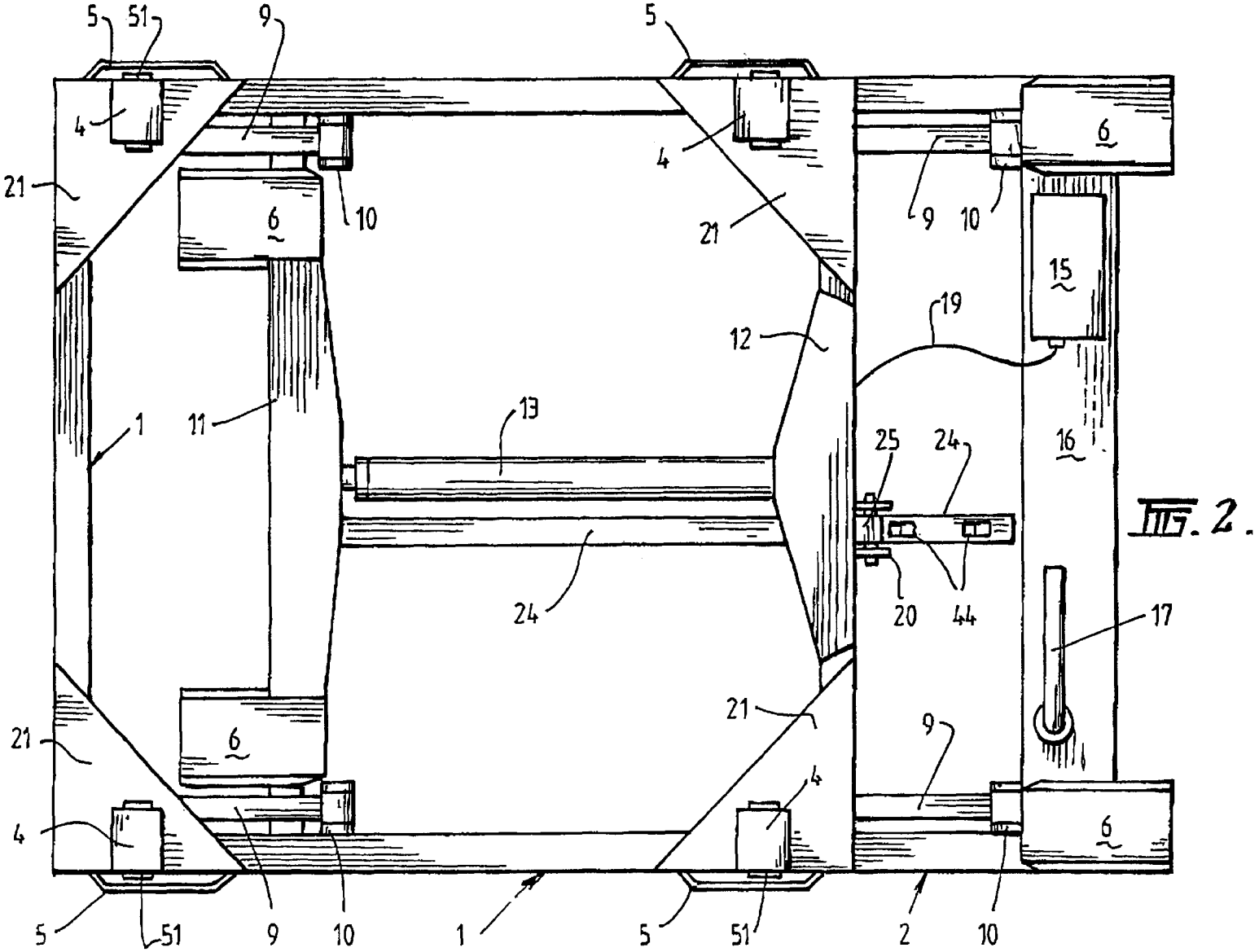
FIG. 2 shows a plan view of the hoist.
Figure 5:
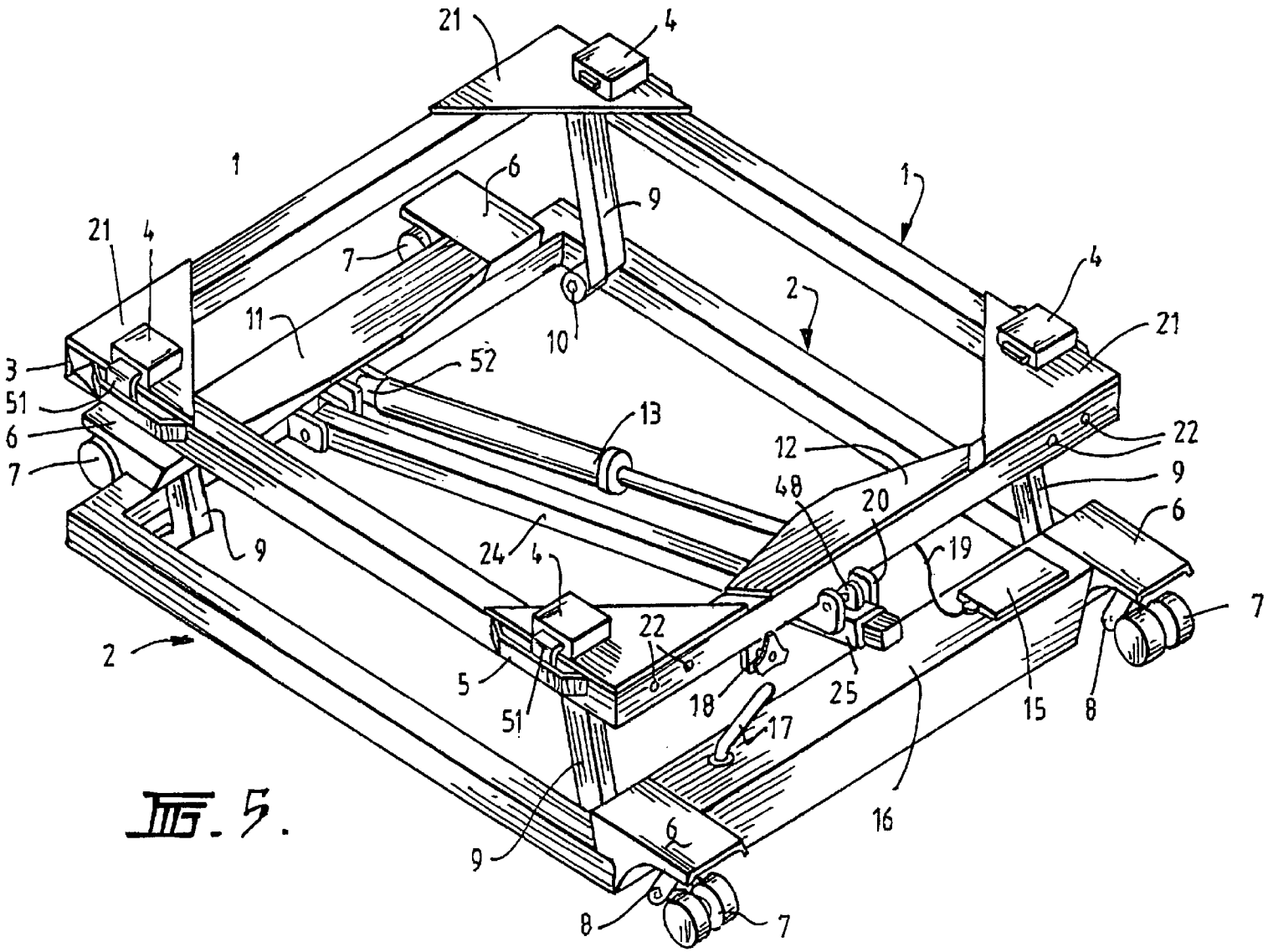
FIG. 5 shows a perspective view of the raised hoist.
Figure 6:
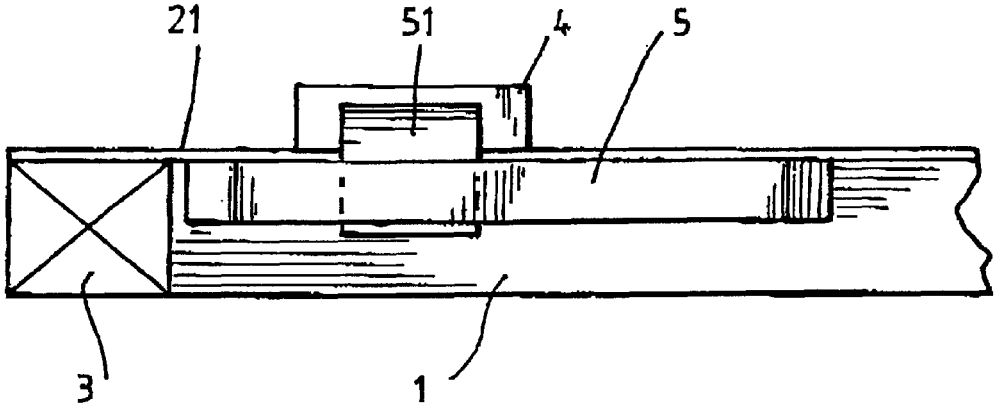
FIG. 6 shows a side view of sliding rubber blocks fitted to the hoist.
Figure 7:
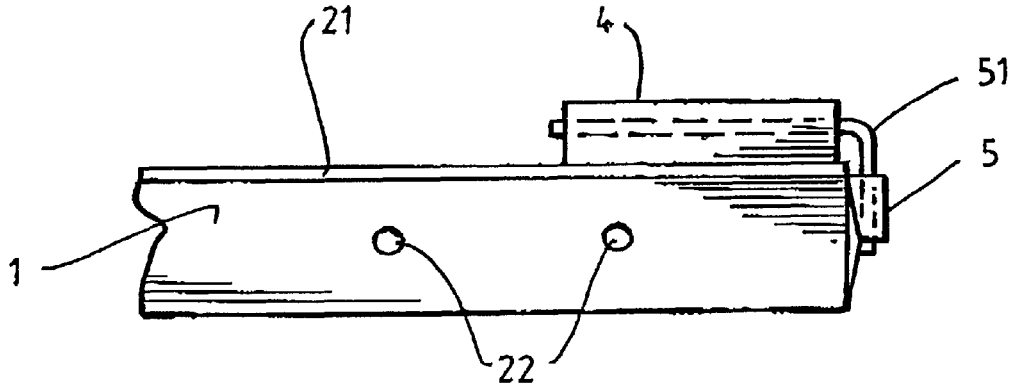
FIG. 7 shows an end view of a rubber block.
Figure 8:
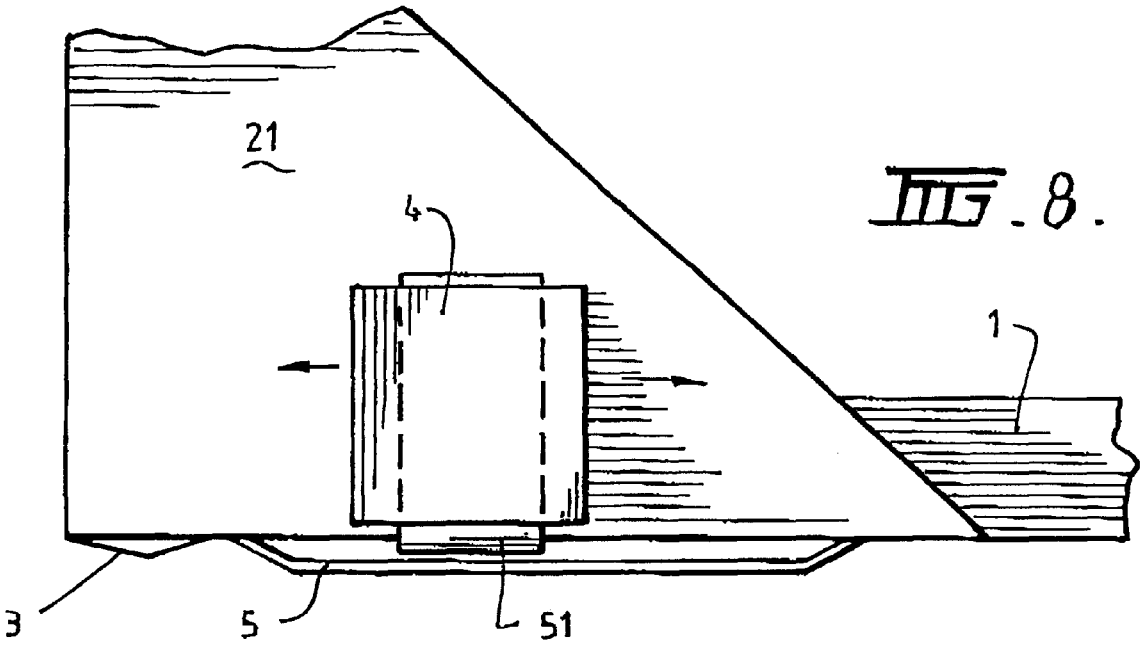
FIG. 8 shows a plan view of a rubber block.

Reverting back to FIG. 2, a plan view of the hoist sliding rubber blocks 4 are positioned at each of the comers of the upper platform 1 and are slidable along channels 5 so as to accommodate any particular vehicle being mounted on the hoist. The particular details of the sliding rubber blocks are shown in FIGS. 6 to 8.

The invention provides for the first time a compact vehicle body hoist capable of readily lifting a motor vehicle body to a height of about 1 meter or to a height any where in between and allowing a vehicle so raised to be readily manipulated and moved around a floor area without fear of instability. In this manner the hoist can be used as a mechanism for raising a vehicle body in its entirety above a workshop floor to allow ready access for work underneath or can also be used as a mechanism for lifting a vehicle body in its entirely off the floor for the purposes of shifting and general movement of that vehicle body about a workshop in 360° direction within a very confined space. The raising and lowering of the hoist is preferably activated by a hydraulic ram which can be powered by sources readily available to any workshop or alternatively can be electrically or otherwise activated with the provision of batteries or mains power. Alternatively, the hoist could of course be activated by manual jacking mechanism if necessary and in all respects, the hoist provides a highly simplified compact rugged, reliable and substantially safe means of raising and manipulating whole vehicle bodies with a minimum of machinery. The hoist can be provided in various sizes although a footprint of the hoist will generally occupy between 20 and 60% of the footprint of a vehicles wheels so as to provide adequate stability, Dependant on the size of the hoist and vehicle involved, the hoist can be positioned front to rear or side to side of a vehicle in order to accommodate particular movements, stability or offset allowances for a vehicles particular position. The hoist is readily operatable by an unaided operator and provides for one operator, the means to safely manipulate a vehicle to virtually any required position. The locking mechanism of the hoist allows a plurality of hoist units to be used with only one hydraulic system which can be moved from one hoist to the other once a hoist has been raised to its desired height and locked.

When not in use, the hoist forms a compact unit which can be readily stored on a wall or in another out of the way position in a workshop, thereby ensuring that minimum workshop space is taken up with additional machinery. The hoist is virtually maintenance free except for the necessary and routine maintenance of the auxiliary hydraulics and pivots and accordingly, a workshop can be provided with a plurality of hoists of the above invention for a minimum of outlay whilst providing a maximum of use of a given workshops floor space and man power.

Accordingly, the invention provides for the first time a fully mobile hoist for raising, manipulating and handling motor vehicles. Rather than having to rely on the prior art collection of available hoisting mechanisms which only facilitate the temporary movement or raising elevation or manipulation of a vehicle, the current invention provides a means of not only mobilising a damaged vehicle, but also enables a wide range of manipulation of such a vehicle to allow the vehicle to be raised to a variety of heights to facilitate work. It also provides a ready mechanism for a motor vehicle to be raised and moved around readily without any further aid about a workshop floor in a totally safe manner and in a way that once the correct position has been located, the vehicle and hoist can be lowered down onto the ground in a perfectly safe fashion.

What is claimed is:

1. A hoist for a vehicle comprising a chassis member adapted for contact with a substrate upon which the hoist is located and being of a size sufficient to support the vehicle in a stable condition on the substrate when the vehicle is in a raised position, said chassis member including a wheel assembly movable between a first configuration for allowing the wheel assembly to be extended to enable movement of the hoist over the substrate and a second configuration for allowing the wheel assembly to be retracted so that the chassis member is in contact with the substrate thereby preventing unwanted movement of the hoist with respect to the substrate, and a platform member movable between a first position for allowing the hoist to be placed under the vehicle and at least one of a plurality of second positions for supporting the vehicle in one or more raised positions above the substrate, said platform member capable of moving in substantially coplanar relationships to the chassis member to raise or lower the vehicle, wherein, when the wheel assembly is in the first configuration and the platform member is in one of the second positions supporting the vehicle in one of the raised positions, the hoist can be moved from one location to another location over the substrate while maintaining the vehicle on the platform member in a stable condition, and wherein when the wheel assembly is in the second configuration and the platform member is in one of the second positions supporting the vehicle in one of the raised positions, the hoist is prevented from unwanted movement over the substrate, thereby maintaining the vehicle immobile in the raised position, and further wherein the wheel assembly includes at least one retractable wheel connected to the chassis member in such a manner as to allow movement of the hoist in all directions over the substrate, and the hoist further comprising a locking means for maintaining the platform member in at least one of the raised positions with respect to the chassis member.

2. A hoist according to claim 1 in which said at least one wheel is connected to the chassis member in such a way as to allow said at least one wheel to swivel with respect to the chassis member in order to provide movement of the hoist in 360° over the substrate.

3. A hoist according to claim 2 in which said at least one wheel includes a castor wheel system having a swivel housing connected to the chassis member for allowing movement of the hoist in all directions over the substrate.

4. A hoist according to claim 1 in which the wheel assembly includes a plurality of retractable wheels in which the wheels are retracted when in the second configuration so that the chassis member rests on the substrate in use of the hoist to immobilize the hoist against unwanted movement over the substrate.

5. A hoist according to claim 4 in which the retractable wheels are extended when in the first configuration thereby raising the hoist to be clear of the substrate to allow the wheels to contact the substrate in use of the hoist to allow 360° movement of the hoist over the substrate.

6. A hoist according to claim 5 in which the retractable wheels are swivelly connected to the chassis member to allow the hoist to be readily moved across the substrate or to be supported on the substrate as required, by moving the wheels between the two configurations, said retractable wheels including a wheel housing adapted for pivotal swivel fitting to said chassis member and an arm pivoted at one end to the housing and having the retractable wheels fitted to the other end wherein the arm can be moved between a raised position elevating said housing above said substrate so as to extend the wheels for contact with the substrate allowing movement of the hoist and a retracted position in which the wheels are retracted so that the housing rests upon the substrate thereby preventing movement of the hoist with respect to the substrate.

7. A hoist according to claim 6 in which the retractable wheels are moved between said raised and lowered positions by the action of a ram, said ram including a ram body and a piston wherein said wheel housing pivots about said ram body and said piston co-operates with said arm to move the arm between said raised and retracted positions thereby moving the wheels.

8. A hoist according to claim 1 in which the substrate is the floor of a workshop, garage, or factory.

9. A hoist according to claim 1 in which the size of the chassis member corresponds to the footprint of the hoist and the footprint of the hoist is at least 20%, preferably from 20% to 60%, of the footprint of the vehicle to be raised by the hoist.

10. A hoist according to claim 1 in which the locking means includes an elongate locking arm telescopically received through a collar arrangement in which one end of the locking arm is pivotally connected to one end of the chassis member and the collar is pivotally connected to one end of the platform member wherein the end of the chassis member to which the locking arm is connected is the opposite end to the end of the platform member to which the collar is connected such that telescopic movement of the arm through the collar moves the platform member with respect to the chassis member.

11. A hoist according to claim 10 in which the locking means is a pawl fitted to said collar and biased to intercept the travel path of the locking arm so as to co-operate with one or a plurality of steps formed along the length of the locking arm and to arrest the backward movement of the locking arm through the collar.

12. A hoist according to claim 11 in which the steps are indentations formed at spaced apart locations in said locking arm for receiving said pawl to lock the position of the platform member with respect to the chassis member.

13. A hoist according to claim 12 in which the pawl co-operates with the locking arm steps by an overcentre movement such that once said pawl has engaged a step and arrested the backward movement of said locking arm, said pawl is released only after the locking arm has moved forward to allow said pawl sufficient space to move overcentre and withdraw from the step.

14. A hoist according to claim 1, wherein:

the chassis member further includes a first framework arrangement defining the perimeter of the chassis member, the platform member includes a second framework arrangement defining the platform member, said platform member movable between said first position enabling the hoist to be placed under the vehicle in which the platform member is located in contact with the chassis member and at least one of the plurality of second positions supporting the vehicle in one or more raised positions above the substrate in which the platform member is raised above the chassis member, and the hoist further includes:

an extendable ram connected between the chassis member and the platform member to move the platform member relative to the chassis member, and a locking arrangement interconnecting the platform member and the chassis member for maintaining the platform member in one of the second positions supporting the vehicle in one of the raised positions.

15. A hoist according to claim 14 further including:

a plurality of arms to support the platform member in the plurality of second positions supporting the vehicle in one or more raised positions in accordance with movement of the platform member by the ram, wherein each arm includes:

a first portion connected to the platform member, and a second portion rotatably connected to the chassis member to enable rotation of that arm relative to the chassis member, wherein the arms rotate to support the platform member in the substantially coplanar relationships with the chassis member in accordance with platform member movement between the first and plurality of second positions.

16. A hoist according to claim 15, wherein:

the first framework arrangement of the chassis member includes a rectangular configuration with an open interior, wherein the second portion of each arm is rotatably connected to the chassis member toward a respective first framework arrangement corner, and the second framework arrangement of the platform member includes a rectangular configuration with an open interior, wherein the first portion of each arm is connected to the platform member toward a respective second framework arrangement corner.

* * * * *